US007150172B2

(12) United States Patent
Nakazato

(10) Patent No.: US 7,150,172 B2
(45) Date of Patent: Dec. 19, 2006

(54) BURRING DEVICE

(75) Inventor: Kazuhiko Nakazato, Koga (JP)

(73) Assignee: Sanoh Industrial Co., Ltd., Koga (JP)

( * ) Notice: Subject to any disclaimer, the term of this patent is extended or adjusted under 35 U.S.C. 154(b) by 0 days.

(21) Appl. No.: 11/128,310

(22) Filed: May 13, 2005

(65) Prior Publication Data

US 2005/0268684 A1 Dec. 8, 2005

(30) Foreign Application Priority Data

Jun. 4, 2004 (JP) ..... 2004-166499

(51) Int. Cl.
*B21D 28/28* (2006.01)

(52) U.S. Cl. ..... 72/75; 72/343

(58) Field of Classification Search ..... 72/370.27, 72/335, 352, 343, 70, 75, 71, 150; 29/890.148
See application file for complete search history.

(56) References Cited

U.S. PATENT DOCUMENTS 878,604 A * 2/1908 Brinkman ..... 72/150
1,099,669 A * 6/1914 Ruckstinat ..... 72/150
3,155,139 A * 11/1964 Hautau ..... 72/150
5,673,580 A * 10/1997 Ohno ..... 72/70

FOREIGN PATENT DOCUMENTS

JP S59-033036 2/1984

* cited by examiner

*Primary Examiner*—Lowell A. Larson
*Assistant Examiner*—Debra Wolfe
(74) *Attorney, Agent, or Firm*—Posz Law Group, PLC; R. Eugene Varndell, Jr.

(57) ABSTRACT

A burring device is provided which can efficiently perform continuous burring. The burring device has a work holder which has a burring hole and which holds a work object, a pusher rod which rotatably supports the base end of a metal core which has a processing part on the tip end thereof, and a guide rod which is positioned to the front of the extended axis of the pusher rod and which has a guide surface on the tip end thereof which guides the tip end of the metal core towards the burring hole of the holder.

5 Claims, 6 Drawing Sheets

BURRING DEVICE

BACKGROUND OF THE INVENTION

1. Field of the Invention

The present invention relates to a burring device, and more particularly to a burring device suitable for processing of tubular walls.

2. Description of the Related Art

Examples of burring devices for tubular surfaces include those which push a metal core ball out through a lower hole formed in the tube, thereby deforming outward the circumferential edge of the lower hole (Refer to Japanese Patent Application Laid-open No. S59-33036 (FIG. 2 and FIG. 3) and Japanese Patent Application Laid-open No. H8-197151 (FIG. 3 and FIG. 7) for example).

Incidentally, with the burring devices of Japanese Patent Application Laid-open No. S59-33036 (FIG. 2 and FIG. 3) and Japanese Patent Application Laid-open No. H8-197151 (FIG. 3 and FIG. 7), the circumferential edge of the lower hole is deformed by the ball by being pushed out through the lower hole from inside the tube to perform the burring process, but when the next burring process is to be performed, the ball must be returned to the original position, and considerable effort is needed to perform a continuous burring operation.

SUMMARY OF THE INVENTION

With the foregoing in view, an object of the present invention is to provide a burring device which can efficiently and continuously perform a burring process.

In order to accomplish the aforementioned object, the burring device of a first embodiment comprises: a work holder has a burring hole and holds a work object; a pusher rod which rotatably supports a base end of a metal core which has a processing part on a tip end thereof; and a guide rod, which is positioned in front of the extended axis of the pusher rod, has a guide surface on the tip end thereof which guides the tip end of the metal core towards the burring hole of the holder; wherein a lower hole of the work object is aligned with the burring hole in the holder; the tip end of the guide rod is made to correspond to the lower hole of the work object; the pusher rod is moved forward; the metal core is made to contact a guide surface of the guide rod; and the pusher rod is moved forward; and thereby the tip end of the metal core is pressed into the lower hole of the work object and the circumferential edge of the lower hole is bent over.

Furthermore, the burring device of a second embodiment of the invention according to the first embodiment includes the guide surface of the guide rod formed into an arc.

Furthermore, the burring device of a third embodiment of the invention according to the first embodiment includes the processing part of the metal core formed with an arc cross section in the rotational direction, and the processing part is connected to the pusher rod via an arm.

Furthermore, the burring device of a fourth embodiment of the invention according to the third embodiment includes the processing part of the metal core having a spherical shape.

Furthermore, the burring device of a fifth embodiment of the invention according to the first embodiment includes a punch for the lower hole positioned to the outside of the extended axis of the burring hole of the work holder, and a lower hole die formed on the circumferential surface of the guide rod.

Furthermore, the burring device of a sixth embodiment the invention according to the first embodiment includes a coining punch hole formed concentrically with the burring hole of the work holder, positioned to the outside of the burring hole, and having a larger curvature radius than the curvature radius of the burring hole, and a coining punch positioned to the outside of the extended axis of the burring hole.

According to the first embodiment of the invention, a metal core is rotatably connected to the tip end of a pusher rod, so that after the burring process is complete and the pusher rod is pulled out of the work holder, the metal core will simultaneously be pulled out from the burr processing part, and therefore a series of burring processes can be continuously performed.

Furthermore, according to the invention of the aforementioned second embodiment, in addition to the above affect, the guide surface is formed in an arc, so the metal core will be smoothly guided, which can help to conserve the power of the actuator which moves the guide rod.

Furthermore, according to the invention of the aforementioned third embodiment, in addition to the above effect, the processing of the lower hole circumferential edge in the longitudinal direction of the tube can be smoothly performed and a product with good quality can be obtained.

Furthermore, according to the invention of the aforementioned fourth embodiment, in addition to the above affect, a round protruding part can be obtained.

Furthermore, according to the invention of the aforementioned fifth embodiment, in addition to the above affect, the burring process can be performed after a lower hole is made without moving the tube, so the operation of the burring process can be performed more efficiently.

Furthermore, according to the invention of the aforementioned sixth embodiment, in addition to the above affect, the height and thickness of the tip end of the protruding part can be made consistent, and a better product with higher quality can be obtained.

DESCRIPTION OF THE PREFERRED EMBODIMENTS

Figure 1:
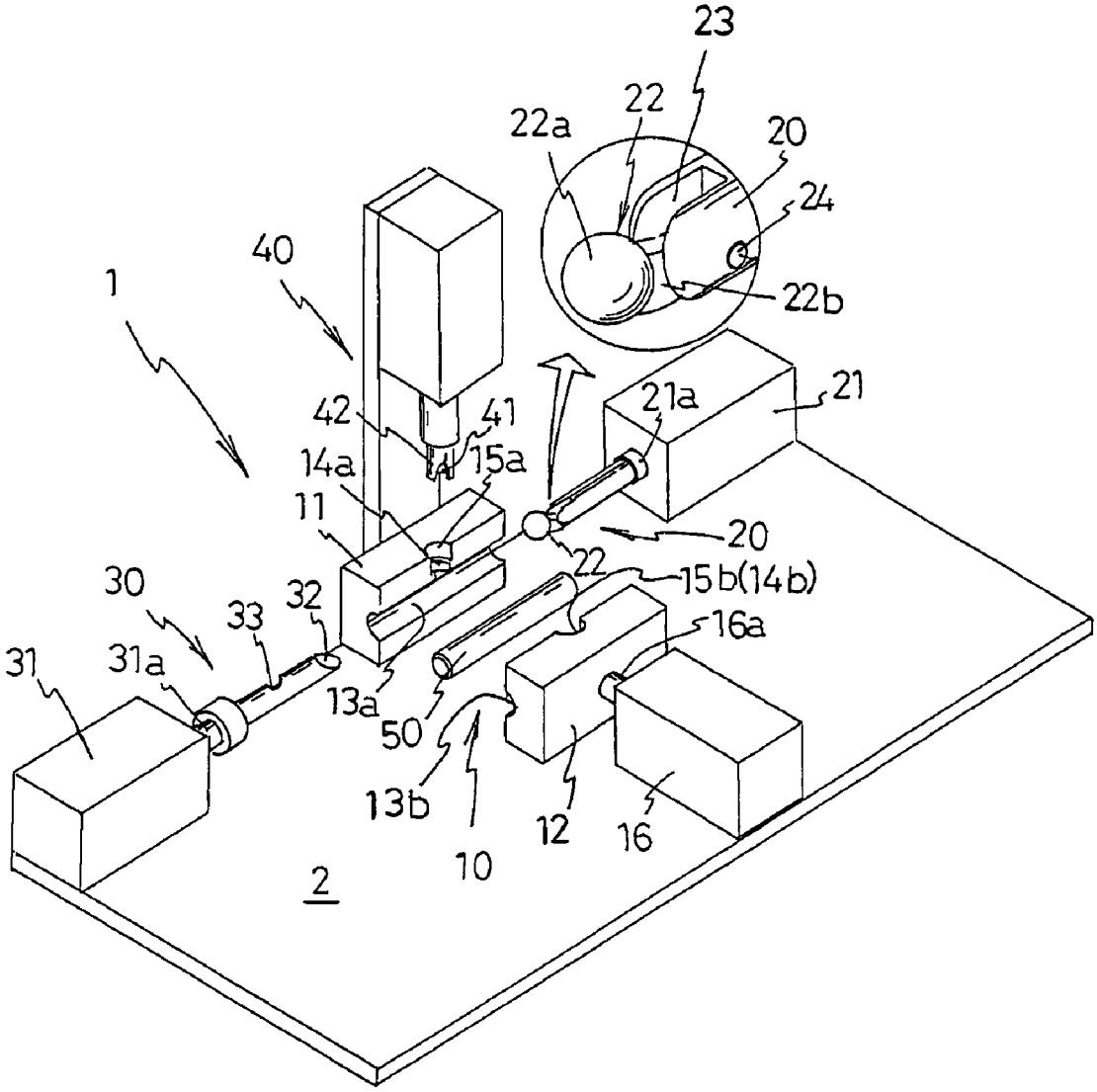
FIG. 1 is a perspective view schematically showing the burring device of the present invention.

The aforementioned burring device of the present invention will be described below in detail while referring to the drawings.

Figure 2:
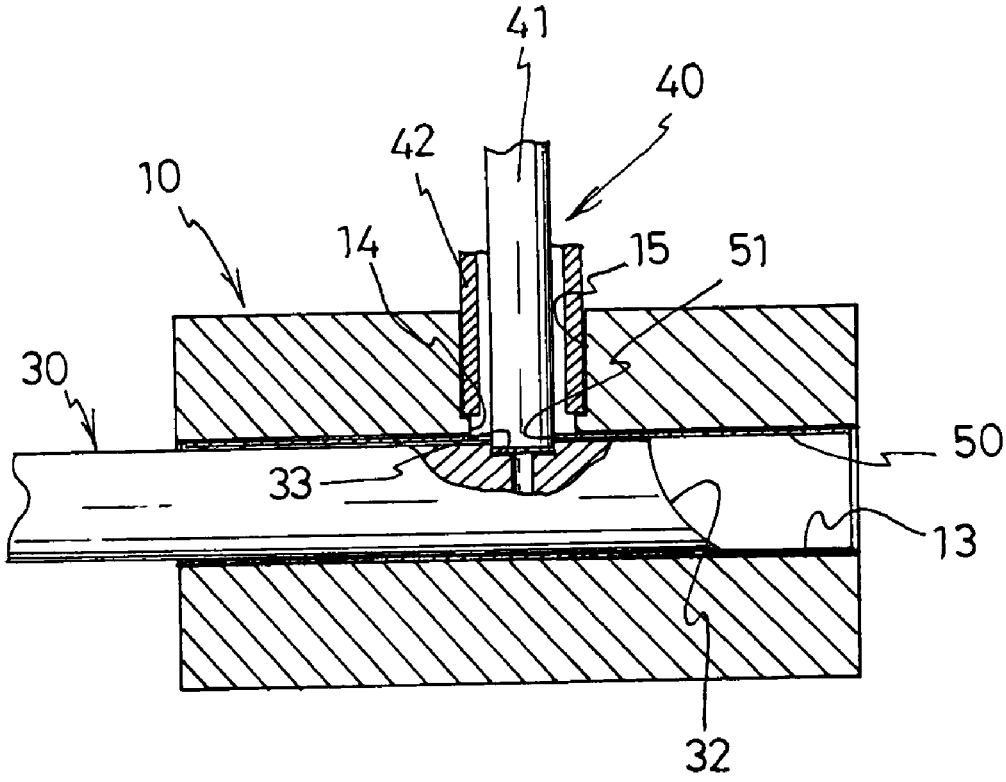
FIG. 2 is a cross-section view of the burring device of FIG. 1 showing the condition where a lower hole is formed in the tube circumferential wall.
Figure 3:
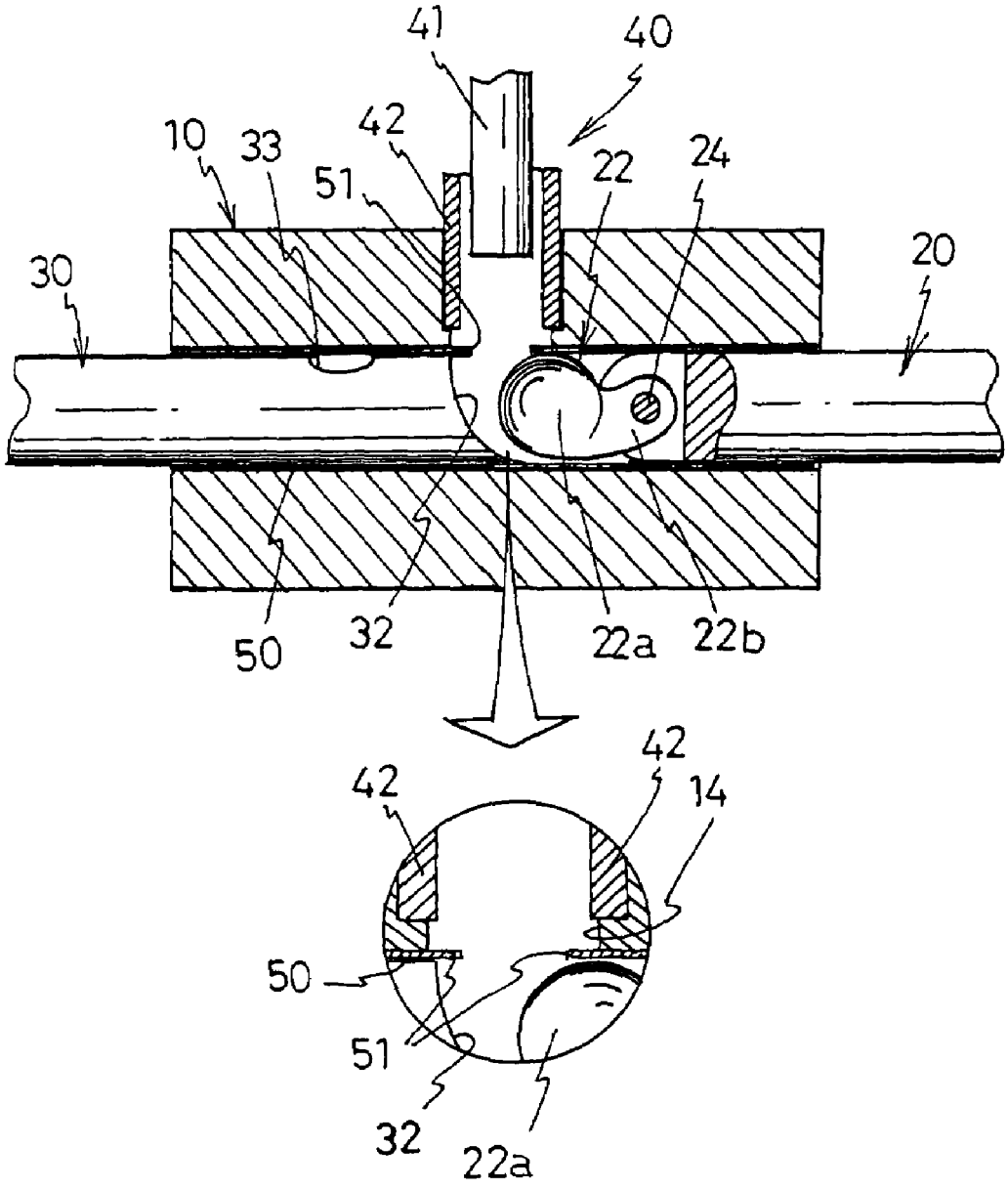
FIG. 3 is a cross-section view of the burring device of FIG. 1 showing the condition prior to performing the burring process on the lower hole formed in the tube circumferential wall.
Figure 4:
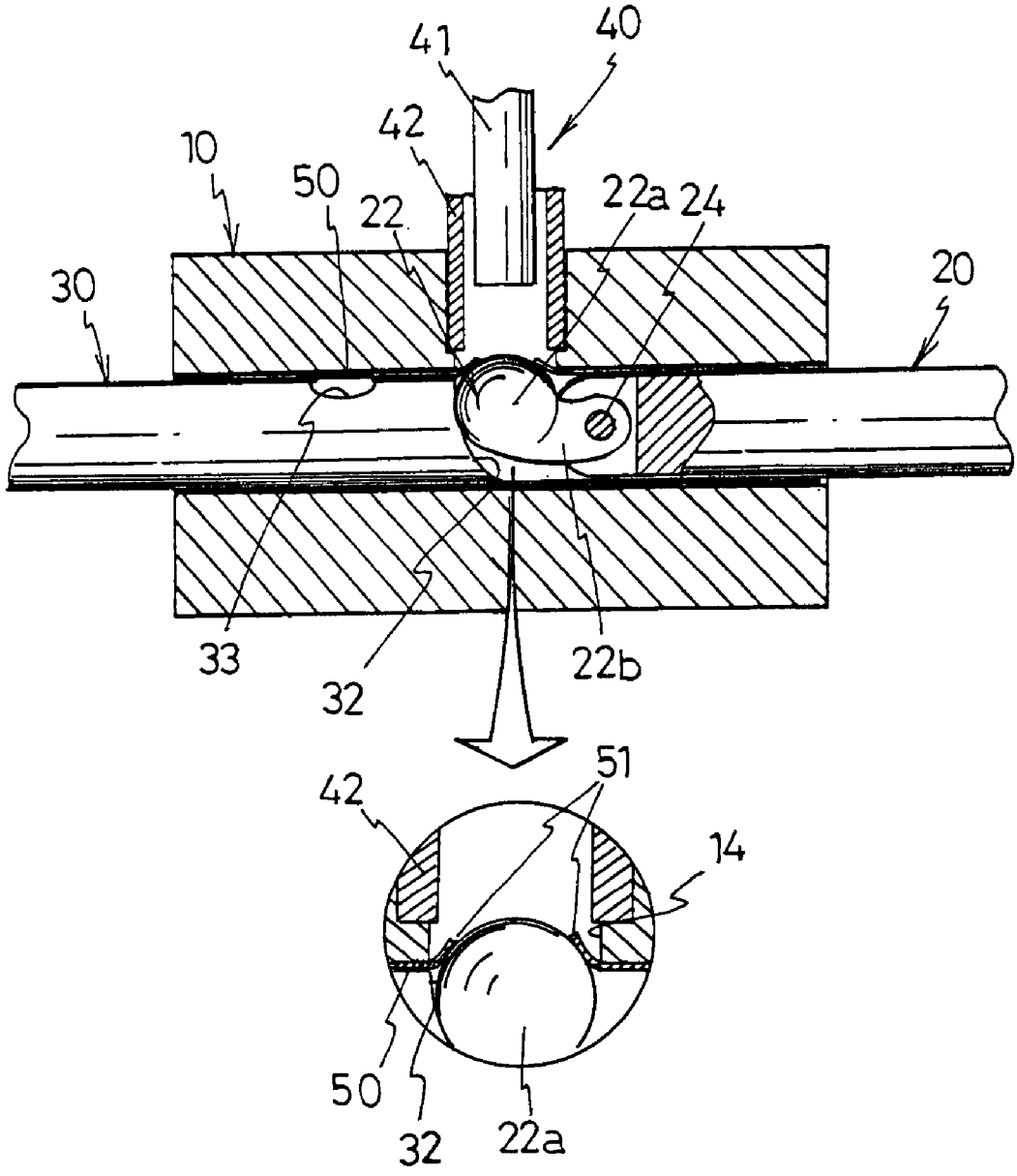
FIG. 4 is a cross-section view of the burring device of FIG. 1 showing the condition during the burring process of the lower hole formed in the tube circumferential wall.
Figure 5:
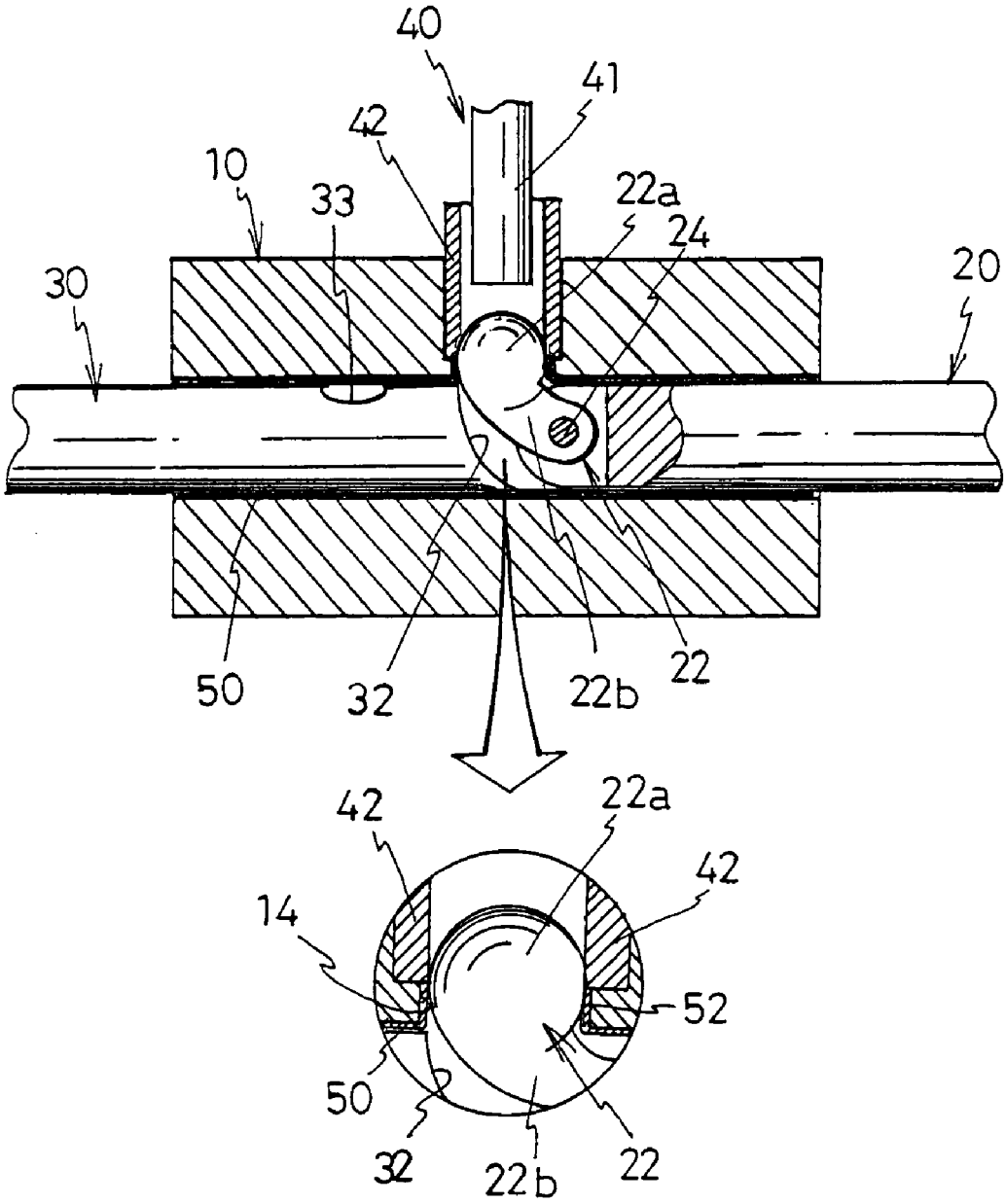
FIG. 5 is a cross-section view of the burring device of FIG. 1 showing the condition when the burring process of the lower hole formed in the tube circumferential wall is complete.

Note, FIG. 1 is a perspective view schematically showing a tube circumferential wall burring device as the burring device of the present invention, FIG. 2 is a schematic cross section view showing the condition where a lower hole is formed in the tube circumferential wall, and FIG. 3 through FIG. 5 are schematic cross section views showing the procedures of the burring process.

The burring device 1 shown in FIG. 1 is comprised of a work holder 10, a metal core pusher rod 20, and a guide rod 30 on a base 2, and is also equipped with a punching means 40.

The work holder 10 is constructed of two separate holder parts 11, 12. Furthermore, the mating surfaces of both of the holder parts 11, 12 have grooves 13*a*, 13*b* respectively, which extend in the horizontal direction to both ends and form a semicircular arc vertical cross section in the longitudinal direction, and small curvature radius grooves 14*a*, 14*b* and large curvature radius grooves 15*a*, 15*b* are formed to be connected together extending vertically up to the top surface forming a semicircular arc horizontal cross section at the middle region of the grooves 13*a*, 13*b*.

Furthermore, the first holder part 11 is mounted to the base 2 and the second holder part 12 is connected to a piston rod 16*a* of a cylinder 16 which is mounted to the base 2. Therefore, the second holder part 12 will be moved toward the first holder part 11, and will be brought into contact with the holder 11, by the cylinder 16.

Therefore, when both holder parts 11, 12 are aligned together, tube insertion hole 13, burring hole 14, and coining punch hole 15 are formed between these holder parts 11, 12.

Metal core pusher rod 20 is positioned on the extended axis of the aforementioned tube insertion hole 13, and the base end is connected to the tip end of a piston rod 21*a* of a cylinder 21 which is mounted on the base 2. Furthermore, the tip end of this metal core pusher rod 20 is equipped with a metal core 22. This metal core 22 has a spherical part 22*a* as a processing part on the tip end, and a curved arm 22*b* protrudes from the back surface of this spherical part 22*a*. Furthermore, the back end of the arm 22*b* is inserted into a slide region 23 formed at the tip end of the metal core pusher rod 20, and is swingingly supported on the core shaft pusher rod 20 by a pin 24.

The guide rod 30 is positioned on the extended axis of the aforementioned tube insertion hole 13, and the base end is connected to a piston rod 31*a* of a cylinder 31 which is mounted to the base 2. This guide rod 30 has a curved arc guide surface 32 formed on the back side facing upward. Furthermore, the center part of the top surface of this guide rod 30 is formed with a lower hole die part 33.

Punching means 40 is equipped on tube 50 with a lower hole punch 41 for forming a lower hole 51 and a coining punch 42 which presses on the protruding part 52 which was formed by the burring process.

With the burring device 1 constructed in this manner, first the tube 50 which is the work object is held in the groove 13*a* of the first holder part 11, and the second holder part 12 is brought into contact with the first holder part 11, thereby retaining tube 50 in the tube insertion hole 13 which is formed.

Guide rod 30 is inserted from one end of the tube 50 in this condition, and the lower hole die part 33 of the guide rod 30 is positioned below the burring hole 14 of the holder 10. Next, the lower hole punch 41 of the punching means 40 is lowered, and a lower hole 51 is formed in the tube 50 as showing in FIG. 2.

Next, the guide rod 30 is slightly retracted as showing in FIG. 3, and the guide surface 32 of this guide rod 30 is positioned beneath the lower hole 51 and the metal core pusher rod 20 is inserted into the tube 50 and the spherical part 22*a* of the metal core 22 is brought into contact with the guide surface 32 of the guide rod 30.

Also, the metal core pusher rod 20 is further inserted. Therefore, the spherical part 22*a* of the metal core 22 is guided to the guide surface 32 of the guide rod 30 as shown in FIG. 4, is pushed into the lower hole 51 of the tube 50, and the circumferential edge of the lower hole 51 is deformed outward.

Next, the metal core pusher rod 20 is further inserted. Then, the spherical part 22*a* of the metal core 22 deforms the circumferential edge of the lower hole 51 along the shape of the burring hole 14 of the holder 10 as shown in FIG. 5. In this case, the end surface of the protruding part 52 that is formed is made to have a consistent height and thickness by the coining punch 42, thus completing the burring process.

Therefore, when the burring process is complete, the metal core pusher rod 20, the guide rod 30 and the coining punch 42 are returned to their respective original conditions, and the holder part 12 of the holder 10 is separated from the holder part 11 and tube 50 is removed from the holder 10.

An embodiment of the burring device of the present convention was described above, but the present invention is not restricted to the above-mentioned embodiments, and various alternates and changes are of course possible within the range of the technical concept of the invention shown in the patent claims.

For instance, in the aforementioned embodiment, a lower hole punch 41 was provided and lower hole 51 was formed in the tube 50 while being held in the work holder 10, but the lower hole punch 41 is not necessary if the lower hole 51 is formed in a different location.

Furthermore, in the aforementioned embodiment, a coining punch 42 was provided, and thereby the height and thickness of the end of the extended part 52 of the tube 50 was made to be consistent, but this coining punch 42 is not absolutely necessary.

Figure 6:
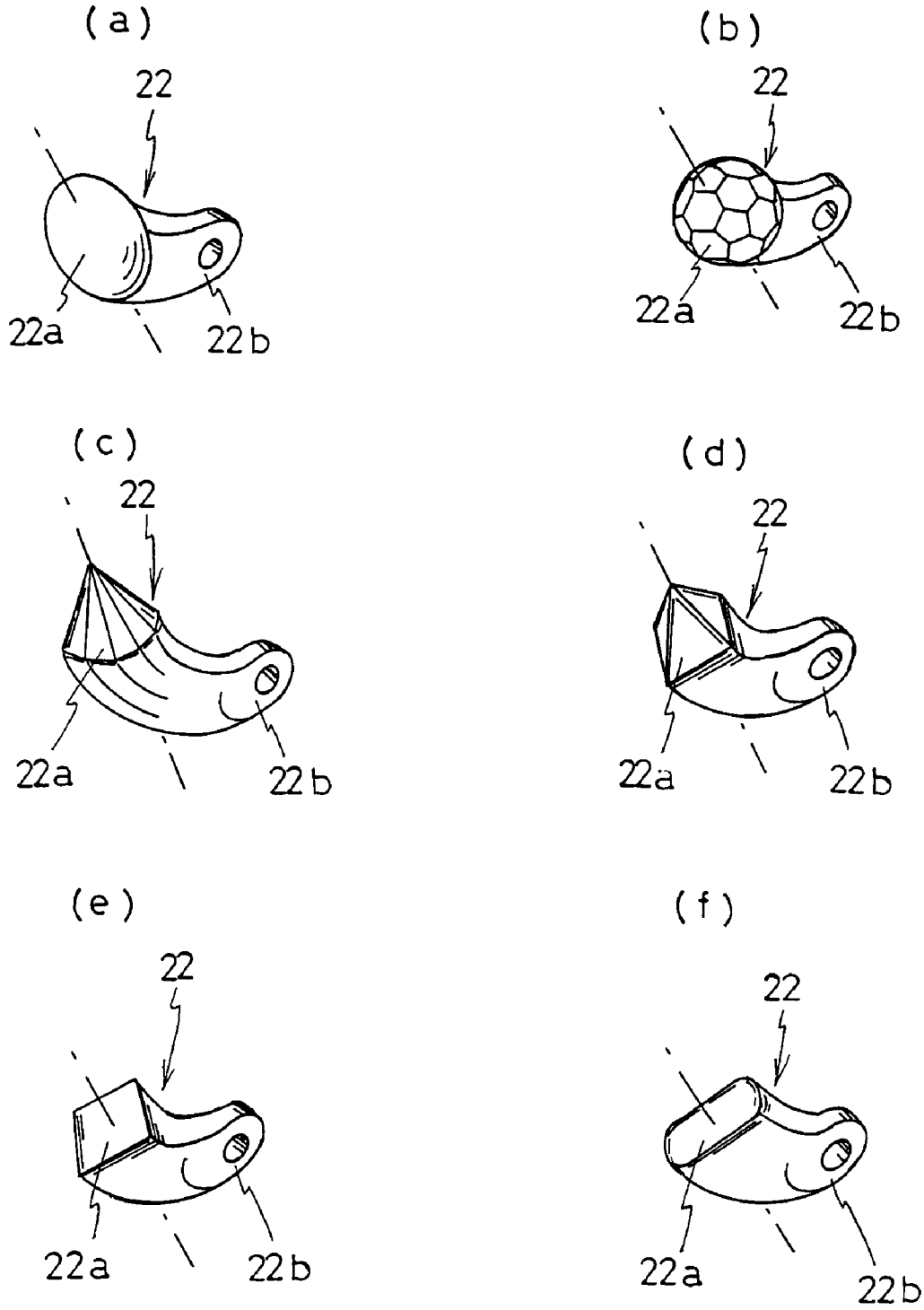
FIG. 6 is a perspective view showing various configurations of the metal core processing part of the burring device of the present invention.

Furthermore, in the aforementioned embodiment, the guide surface 32 of the guide rod 30 was formed in an arc, but a simple sloped surface or a plurality of connected sloped surfaces are acceptable. Furthermore, in the aforementioned embodiment, the processing part 22*a* of the core shaft 22 had a spherical shape, but as shown in FIG. 6, a processing part with an elliptical shape (a), multi-surface shapes (b)–(e), or a combination of curved and flat surfaces (f) may be used.

What is claimed is:

1. A burring device, comprising:

a work holder which has a burring hole and holds a work object;

a pusher rod which rotatably supports a base end of a metal core which has a processing part on a tip end thereof; and a guide rod, positioned in front of the extended axis of said pusher rod, which has a guide surface on the tip end thereof which guides the tip end of said metal core towards the burring hole of said holder; wherein a lower hole of the work object is aligned with the burring hole in said holder;

the tip end of said guide rod is made to correspond to the lower hole of said work object;

said pusher rod is moved forward so that the metal core is made to contact the guide servers of said guide rod;

said pusher rod is moved forward so that the tip end of said metal core is pressed into the lower hole of said work object in the circumferential edge of said lower hole is bent over, and a coining punch hole is formed concentrically with the burring hole of said work holder, positioned to the outside of said burring hole, and having a larger curvature radius than the curvature radius of the burring hole, and a coining punch is positioned to the outside of the extended axis of said burring hole.

2. A burring device, comprising:

a work holder having a burring hole and holding a work object;

a pusher rod arranged in the work holder, the pusher rod having a metal core arranged on an end thereof; the metal core including a base end rotated to the pusher rod by a pin, a processing part on a tip end thereof, and an arm extending between the base end and the processing part thereof;

a guide rod being arranged in the work holder on a common axis with the pusher rod, the guide rod having a guide surface on a tip end thereof; the guide surface facing the tip end of the processing part of the metal core of the pusher rod and being adapted to guide the processing part of the metal core towards and into the burring hole of the work holder, while the arm and an inner surface of the processing part of the metal core avoid contact with the burring hole of the work holder;

the guide surface having a concave surface receiving the tip end of the processing part of the metal core, and guiding the tip end of the processing part of the metal core toward and through the burring hole of the work holder; wherein the work holder, pusher rod and guide rod cooperate together by:

a hole in the work object aligning with the burring hole in the work holder;

the tip end of the guide rod aligning with the burring hole of the work holder and the hole in the work object;

the pusher rod moving forward and causing the tip end of the processing part of the metal core to contact the guide surface of the guide rod; and the pusher rod moving further forward and pressing the tip end of the processing part of the metal core through the hole in the work object and into the burring hole of the work holder, thereby bending over the circumferential edge of the hole in the work object.

3. The burring device according to claim 2, wherein the processing part of the metal core has a spherical shape.

4. The burring device according to claim 2, wherein the processing part of the metal core has a non-spherical shape.

5. A burring device, comprising:

a work holder having a burring hole and holding a work object;

a pusher rod arranged in the work holder, the pusher rod having a metal core arranged on an end thereof; the metal core including a base end rotated to the pusher rod by a pin, a processing part on a tip end thereof, and an arm extending between the base end and the processing part thereof;

a guide rod being arranged in the work holder on a common axis with the pusher rod, the guide rod having a guide surface on a tip end thereof; the guide surface facing the tip end of the processing part of the metal core of the pusher rod and being adapted to guide the processing part of the metal core towards and into the burring hole of the work holder, while the arm and an inner surface of the processing part of the metal core avoid contact with the burring hole of the work holder;

a punch for punching a hole in the work object being arranged within the burring hole of the work holder, and a lower hole die is formed on a circumferential surface of the guide rod receiving the punch;

the guide surface having a concave surface receiving the tip end of the processing part of the metal core, and guiding the tip end of the processing part of the metal core toward and through the burring hole of the work holder; wherein the work holder, pusher rod and guide rod cooperate together by:

the hole in the work object aligning with the burring hole in the work holder;

the tip end of the guide rod aligning with the burring hole of the work holder and the hole in the work object;

the pusher rod moving forward and causing the tip end of the processing part of the metal core to contact the guide surface of the guide rod; and the pusher rod moving further forward and pressing the tip end of the processing part of the metal core through the hole in the work object and into the burring hole of the work holder, thereby bending over the circumferential edge of the hole in the work object.

* * * * *